US005538587A

United States Patent [19]

Sakano et al.

[11] Patent Number: 5,538,587

[45] Date of Patent: Jul. 23, 1996

[54] DEVICE FOR CONNECTING WEB END PORTIONS

[75] Inventors: Makoto Sakano; Shuitiro Oku; Shozo Horikawa; Mituhalu Ikeda; Yoshihiko Mashiko, all of Tokyo, Japan

[73] Assignee: Japan Tobacco Inc., Tokyo, Japan

[21] Appl. No.: 267,923

[22] Filed: Jul. 6, 1994

Related U.S. Application Data

[63] Continuation of Ser. No. 969,385, Oct. 30, 1992, abandoned.

[30] Foreign Application Priority Data

| | | | |
|---|---|---|---|
| Oct. 31, 1991 | [JP] | Japan | 3-311383 |
| Oct. 31, 1991 | [JP] | Japan | 3-311384 |
| Oct. 31, 1991 | [JP] | Japan | 3-311385 |
| Oct. 31, 1991 | [JP] | Japan | 3-311386 |
| Oct. 31, 1991 | [JP] | Japan | 3-311390 |
| Oct. 31, 1991 | [JP] | Japan | 3-311391 |

[51] Int. Cl.[6] ..... B31F 5/00; G03D 15/04

[52] U.S. Cl. ..... 156/505; 156/504; 156/506; 156/517; 156/519; 242/555.1; 242/555.3

[58] Field of Search ..... 156/502, 504, 156/505, 506, 516, 517, 519; 242/555, 555.1, 555.2, 555.3

[56] References Cited

U.S. PATENT DOCUMENTS

| | | | |
|---|---|---|---|
| 3,197,152 | 7/1965 | Rakowicz et al. . | |
| 3,907,235 | 9/1975 | Gaubert . | |
| 3,939,032 | 2/1976 | Taitel et al. | 156/505 |
| 3,939,034 | 2/1976 | Tanaka et al. | 242/58.5 X |
| 4,466,577 | 10/1984 | Focke et al. | 242/58.1 X |
| 4,659,414 | 4/1987 | Heitmann et al. | 156/505 X |
| 4,848,691 | 7/1989 | Muto et al. | 242/58.1 |
| 4,878,982 | 11/1989 | Ogata et al. | 156/361 |
| 4,984,750 | 1/1991 | Shigeta et al. | 156/505 X |

FOREIGN PATENT DOCUMENTS

| | | |
|---|---|---|
| 0299181 | 1/1989 | European Pat. Off. . |
| 1235335 | 3/1967 | Germany . |
| 63-165258 | 7/1988 | Japan . |
| 63-162434 | 7/1988 | Japan . |
| 218249 | 2/1990 | Japan . |
| 2286549 | 11/1990 | Japan . |
| 2091224 | 7/1982 | United Kingdom . |
| 2114101 | 8/1983 | United Kingdom . |
| 2167047 | 5/1986 | United Kingdom . |

*Primary Examiner*—David A. Simmons
*Assistant Examiner*—Paul M. Rivard

[57] ABSTRACT

A device for connecting a trailing end of a previously drawn-out web from a first web roll to a leading end portion of a newly drawn-out web from a second web roll has a vertical guide unit, a drawing-out unit, a feeding unit, an adhesive tape supplying unit and cutting members. The previously drawn-out web which is running vertically downward is guided by the vertical guide unit. The leading end portion of a web is drawn out from a new web roll by the drawing-out unit and moved vertically downward by the feeding unit in the vicinity of and along the previously drawn-out web. An adhesive tape is attached to the leading end portion of the newly drawn-out web by the adhesive tape supplying unit. The leading end of the newly drawn-out web is connected to the trailing end of the previously drawn-out web by the adhesive tape. After the previously and newly drawn-out webs have been connected together, the excess portions of both webs are removed by the cutting members.

6 Claims, 14 Drawing Sheets

DEVICE FOR CONNECTING WEB END PORTIONS

This application is a continuation of application Ser. No. 07/969,385 filed on Oct. 30, 1992, now abandoned.

BACKGROUND OF THE INVENTION

1. Field of the Invention

This invention relates to an apparatus for connecting end portions of two webs, and more particularly to an apparatus for taking off the web from a web roll comprising a core and the web wound therearound, supplying the same to the succeeding apparatus, and drawing out the web from a new web roll when the web has left from the preceding web roll and connecting the leading end portion of the web on the new web roll to the trailing end of the web drawn out from the preceding web roll.

2. Description of the Related Art

In the conventional cigarette manufacturing process, belt-like paper sheets are wound around cigarette material to form elongated cigarette rods, and thereafter the rods are cut into pieces each having a predetermined length. Similarly, when filters are manufactured in the conventional process, belt-like paper sheets are also wound around filter sheets made of fiber or the like to form elongated filter rods and thereafter the filter rods are cut into pieces each having a predetermined length.

Therefore, continuous supply of the above-mentioned belt-like paper pieces, i.e., webs is required for producing cigarette rods and filter rods. Such a web is usually supplied in a form of a web roll comprising a core and a web wound around a roll, as shown in FIG. 7. The web roll is mounted in a web supplying apparatus and the web is continuously taken off from the web roll and is supplied therefrom to the succeeding apparatus. When the web on the web roll is fully used, a web is taken off from a new web roll and the leading end of the new web is connected to the trailing end of the web from the old web roll. In such a way, webs are supplied continuously.

There has been recently developed a web supplying device which is provided with two web rolls so as to perform these processes automatically. A web is taken off from a first web roll and is supplied to the succeeding apparatus. When the web on the first web roll is fully used, a web is drawn out from the second web roll which was in a waiting state, and the leading end of the web on the second web roll is automatically connected to the trailing end of the web of the first web rib. Thereafter, the core and other necessary parts are removed from the web supplying apparatus, and a new web roll is mounted thereon. With this web supplying device, this series of web supplying and web replacing processes is repeated so that webs are supplied continuously.

The transporting and connecting processes are complicated when using the conventional automatic web connecting device. In order to connect webs, the device requires such a series of complicated processes that the trailing end portion of the web which has already been drawn out is held at an accurate position, the leading end portion of the web newly drawn out is made to overlap with the trailing end portion of the preceding web accurately, both leading and trailing end portions are pressed against each other so as to be connected by an adhesive tape or the like which is disposed therebetween, and the excess portions of the webs are cut.

The mechanisms for performing these processes are collectively arranged on and in the vicinity of the portions of the webs to be connected. Thus, the spaces for admitting these mechanisms are limited. Further, since the webs are flexible and the leading end portion of the newly drawn-out web is made free, special care must be paid to handle them.

In this connection, it is required that the automatic web connecting device have high operational reliability and a simple structure.

SUMMARY OF THE INVENTION

The object of this invention is to provide a web connecting device which securely performs the processes of connecting the leading end portion of the newly drawn-out web to the trailing end portion of the previously drawn-out web and cutting excess portions of the leading and trailing portions, and which has a simple structure.

In order to achieve this object, this invention is characterized by vertical guide means for guiding a vertically running web which has already been drawn out; feeding means for vertically feeding the leading end portion of a newly drawn-out web in the vicinity of and along the portion of the previously drawn-out web which is guided by the guide means; and adhesive tape supplying means for attaching an adhesive tape to the leading end portion of the newly drawn-out web.

Since the leading end portion of the newly drawn-out web is moved in a vertically suspending state due to its own weight, this device feeds and guides the leading end portion easily, and the mechanisms for feeding and guiding the leading end portion of the newly drawn-out web are simplified and operated accurately.

In a preferred embodiment, the guide means for running and guiding the leading end portion of the newly drawn-out web is provided with an endless air-permeable belt which is wound on a hollow main body and is driven vertically downward, i.e., in the running direction of the newly drawn-out web. The pressure of the interior of the hollow main body is maintained negative so that air is introduced in the main body through the air-permeable belt. Thus, the leading end portion of the newly drawn-out web is sucked by the belt and guided and runs on a predetermined path. Since this device does not have any mechanical portions for holding the leading end portion of the newly drawn-out web but guides and drives the same by the weight of the leading portion and the sucking force produced by air introduced in the main body, the leading end portion in a free state is guided and fed accurately and the device is operated so safely that the webs are not damaged.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

An embodiment of this invention will now be described with reference to the accompanying drawings. The device according to this embodiment is intended to automatically and continuously supply webs to machines for manufacturing cigarette rods, filter rods and the like via a web supply-connection apparatus. This device has a web roll storage-mounting unit for mounting web rolls on the web supply-connection apparatus automatically.

Figure 7:
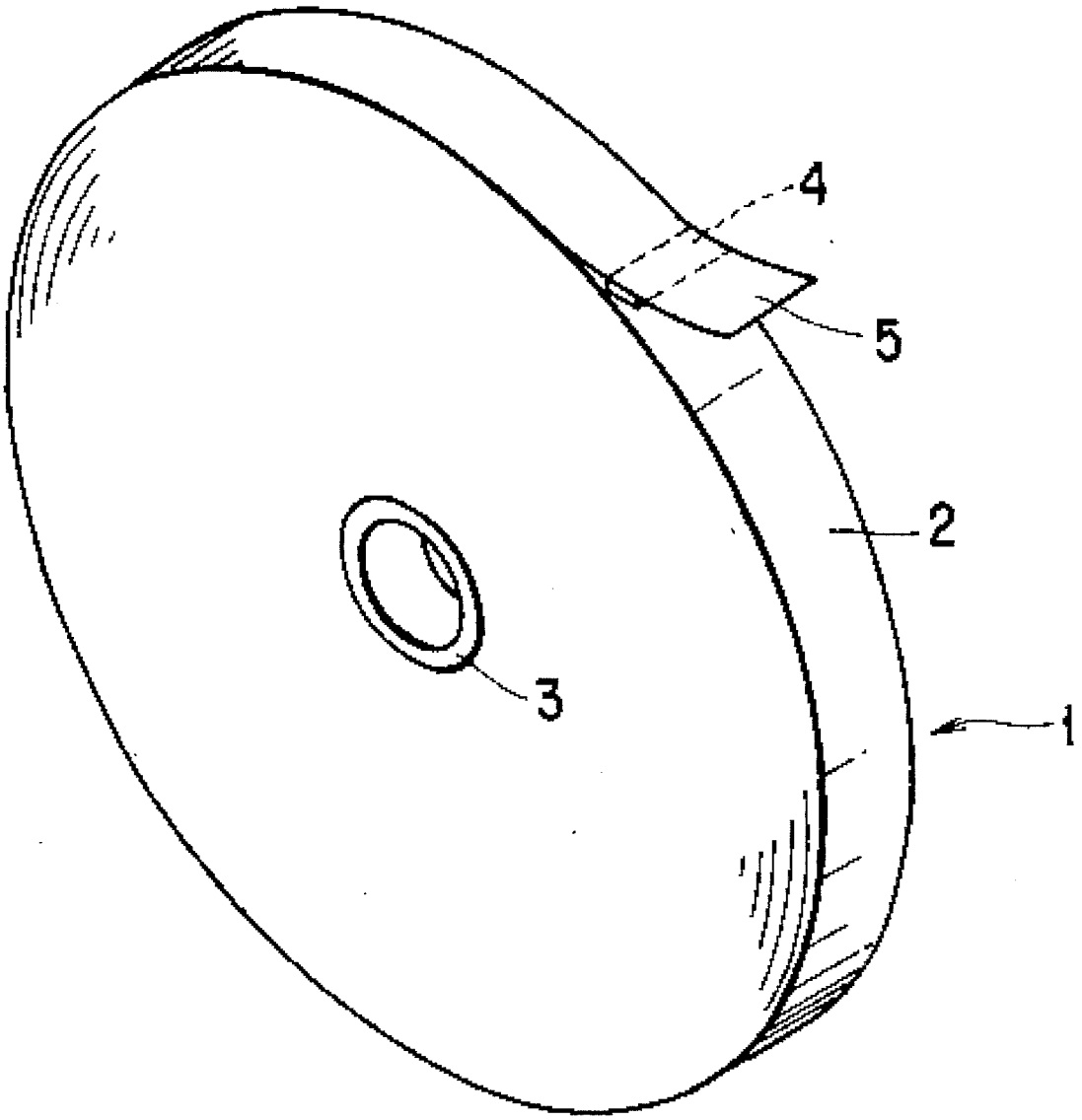
FIG. 7 is a perspective view of a web roll.

A web roll 1 used in the device according to this invention will now be described with reference to FIG. 7. The web roll 1 comprises a core 3 and a web 2 wound therearound. The leading end portion of the web 2 is temporarily attached to the body of the web 2 by an adhesive tape 4 which has such a weak adhering force that the leading end of the web 2 is easily detached from the body of the web 2. The part of the leading end portion of the web 2 between the leading edge thereof and the adhesive tape 4 forms a detaching part 5 having a length of about 4 to 5 mm.

Referring to FIGS. 1 to 4, the overall device according to this invention will now be described. In the figures, a web supply-connection apparatus is designated at 100 and is adapted to continuously take off and supply a web from the respective web roll 1*a* and take off and supply a web from a new web roll 1*b* when the web on the web roll 1*a* is fully used. The apparatus 100 connects the leading end portion of the web on the web roll 1*b* to the trailing end portion of the web which was on the web roll 1*a*. During the supply of the web from the web roll 1*b*, the core 3 of the web roll 1*a* is replaced with a new web roll. The process comprising the supply of the webs, the change of the web rolls, the connection of the webs and the replacement of the web rolls is repeated so that the webs are supplied continuously.

The web 2 is guided by guide rails 301 and supplied from the web supply-connection apparatus 100 to, for example, a cigarette rod manufacturing apparatus 300 having a reservoir box 302 in which a predetermined length of a portion of a web 2 is stored. While the supply of the web from the respective web roll is temporarily stopped in order to connect the corresponding end portions of the webs, the web portion in the reservoir box 302 is supplied.

A web roll storage-mounting unit 200 is disposed opposed to the front face of the web roll supply-connection apparatus 100. The unit 200 stores and holds a great number of web rolls 1 and automatically mounts the web rolls 1 one by one on the web supply-connection apparatus 100 when the web on a web roll is fully used.

A control unit 400 has a control panel and control circuits for controlling the operation of the overall device.

Figure 1:
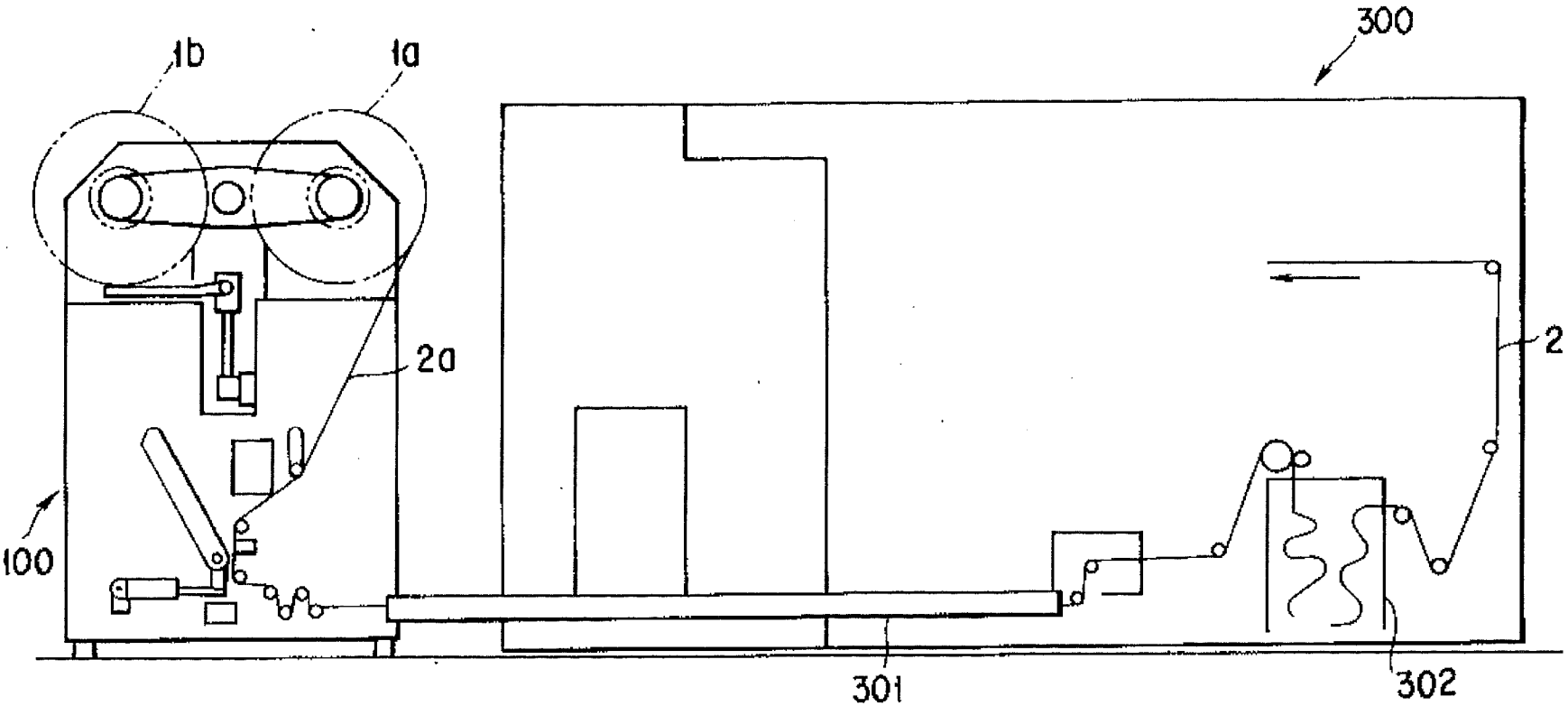
FIG. 1 is a front view of the overall device according to one embodiment of this invention.
Figure 2:
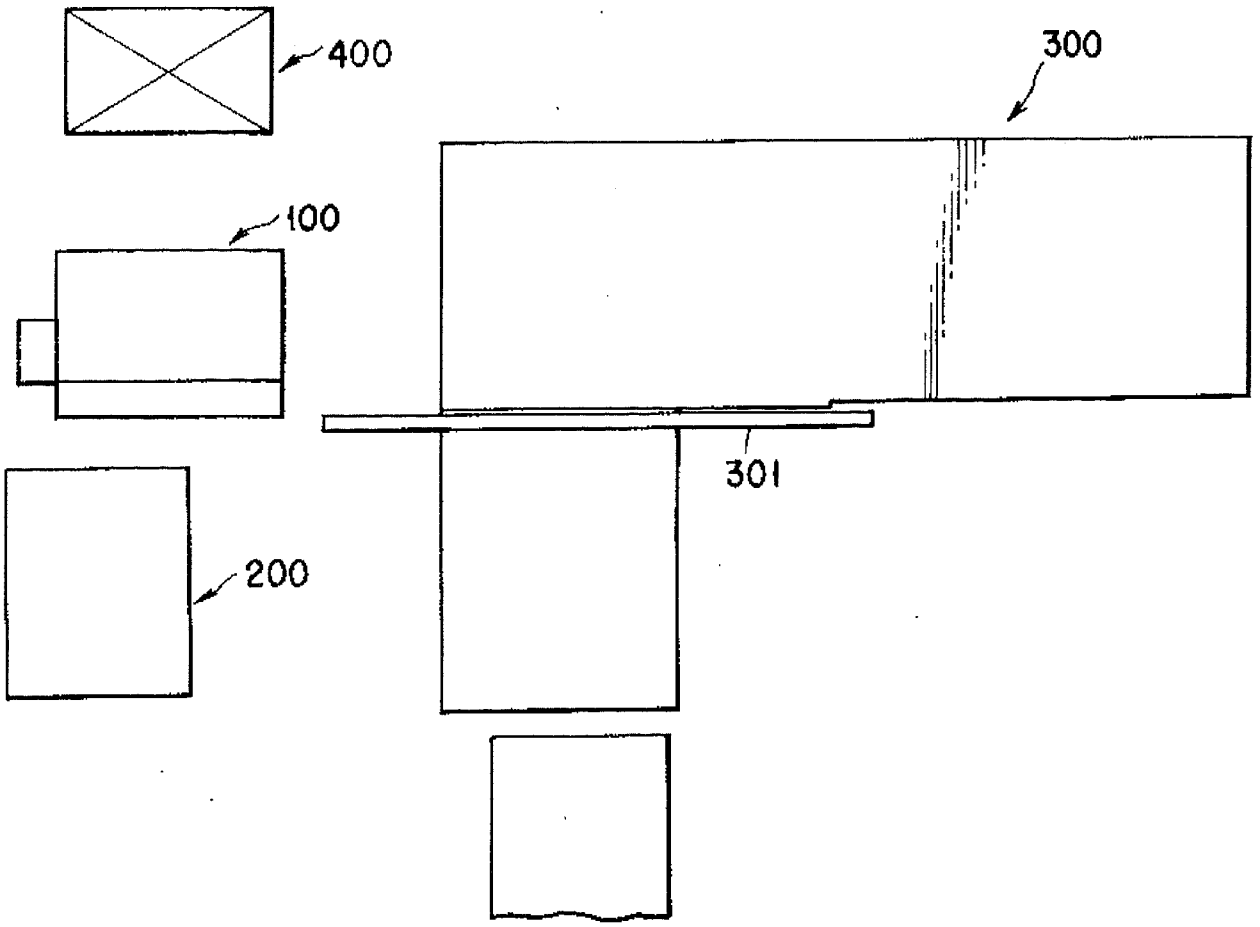
FIG. 2 is a plan view of the overall device according to this embodiment of this invention.
Figure 3:
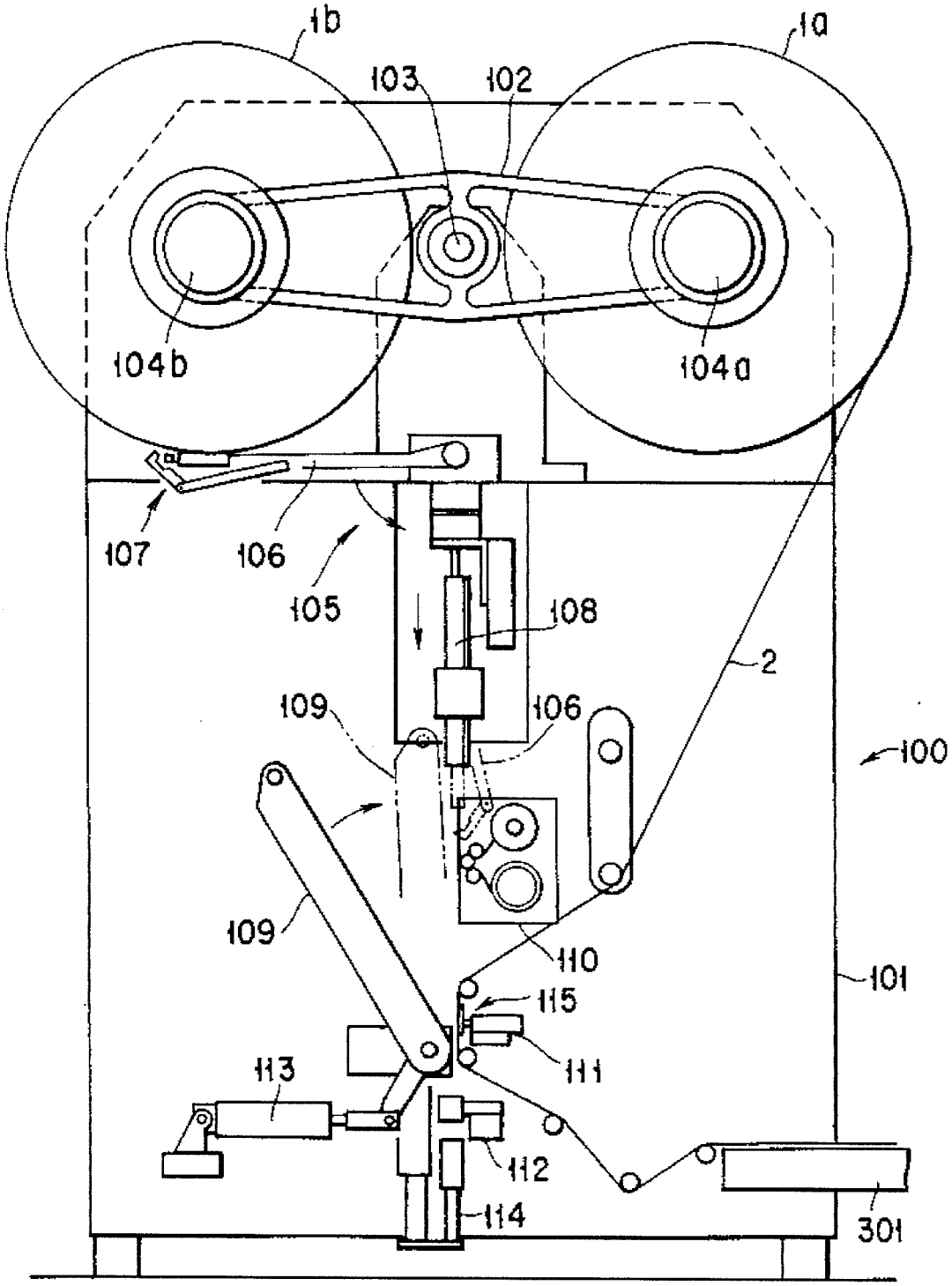
FIG. 3 is an elevational view of a web supply-connection apparatus.

The general structure of the web supply-connection apparatus 100 will now be described with reference to FIG. 3. The main body of the apparatus 100 is designated at 101 in the figure. Provided on the upper portion of the front face of the main body 101 is a rotary arm 102 which is rotatable in a vertical plane about a central rotary shaft 103. On both ends of the rotary arm 102 are provided hubs 104*a* and 104*b* on which web rolls 1 are mounted. In the state of FIG. 3, a web 2*a* is being taken off from a web roll 1*a* mounted on the right-side hub 104*a*, and a web roll 1*b* on which a web is fully wound and which is mounted on the left-side hub 104*b* is in a waiting state.

The web 2 taken off from the right-side web roll 1*a* is guided by a plurality of rollers and supplied to the cigarette manufacturing apparatus 300 through the guide rails.

A drawing-out mechanism 105 is provided under the web rolls and has a drawing-out arm 106 which is rotatable in a vertical plane, is movable vertically by a lifting mechanism 108 and is also movable back and forth. A chucking mechanism 107 is provided on the front end of the drawing-out arm 106.

After a new web roll 1*b* has been mounted, the front end of the drawing-out arm 106 abuts the lowest surface portion of this web roll 1*b* which is in the waiting state, and the chucking mechanism 107 catches the detaching part 5 of the web 1*b*. While the drawing-out arm 106 rotates downward to the vertical position, the web 2 is drawn out, and the arm 106 is lowered by the lifting mechanism 108 to the position shown by two-dotted lines in FIG. 3.

A feed mechanism 109 is pivoted at its lower end to the lower portion of the front face of the main body 101 and is rotated by a cylinder 113 in a vertical plane. The feed mechanism 109 has an endless suction belt which is formed with a great number of holes and whose inner pressure is rendered negative. After having been rotated to the vertical position shown by the two-dot lines in FIG. 3, the feed mechanism 109 sucks the leading end of the web 2 held by the drawing-out arm 106 and receives the web 2. Thereafter, the suction belt is moved so as to send the leading end of the web down-ward.

An adhesive tape supplying mechanism 110 is also provided on the front face of the main body 101. An adhesive tape such as a double-side adhering type adhesive tape is attached by the adhesive tape supplying mechanism 110 to the leading end portion of the web which the feed mechanism 109 is holding.

The web to which the adhesive tape has been attached is further moved downward by the feed mechanism 109 and overlaps with the vertically running portion of the web roll 1 which has already been taken off. Then, the previously taken-off web stops and is pressed by a pushing mechanism 111 against the leading end portion of the web which is being taken off so that both webs are connected by the adhesive tape.

A cutting mechanism 112 and a chucking mechanism 114 are provided on the lower portion of the main body 101. After the leading end portion of the web, which is being drawn out, has been held and provided with a predetermined tension by the chucking mechanism 114, this web is cut at the portion just ahead of the adhesive tape by the cutting mechanism 112 and the excess portion of the leading end portion of this web is removed.

The portion of the previously drawn-out web which is rearward of the adhesive tape is also cut by a cutter provided on the pushing mechanism 111. In this connection, the leading end portion of the web which is being drawn out from the web roll 1*b* and the tailing end portion of the already drawn-out web are connected by the adhesive tape.

The rotary arm 102 rotates through 180° and the web roll 1*b* from which the web is being taken off is moved to the right side. The core of the web roll 1*a* from which the web has been taken off is removed from the hub 104*a* and the hub 104*a* from which the core has been removed (hereinafter referred to as "the free hub") is moved leftward.

After this, a new web roll is mounted on the free hub 104*a* from the web roll storage-mounting unit 200.

Figure 4:
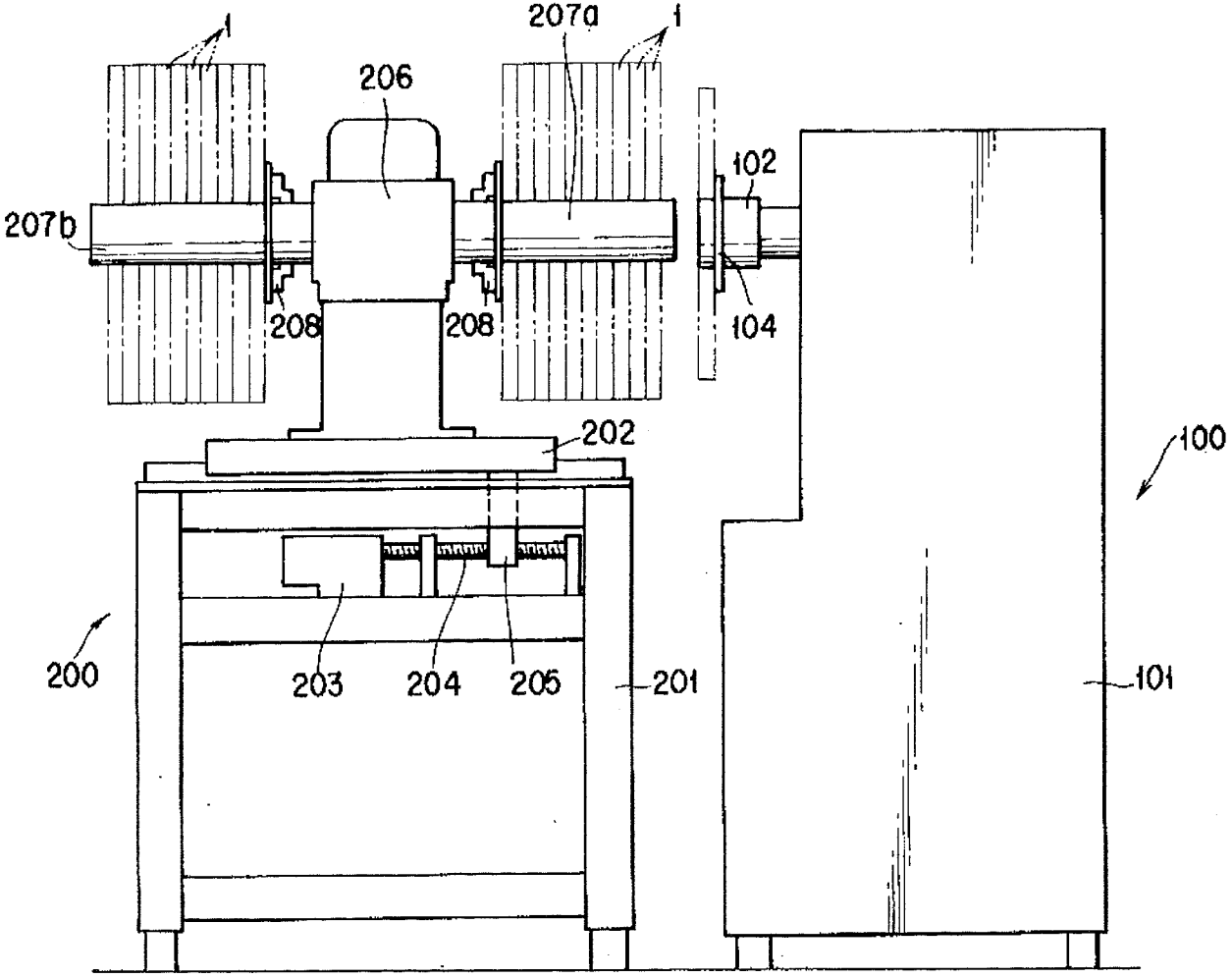
FIG. 4 is a side view of a web roll storage-mounting unit.

The general structure of the web storage-mounting unit 200 will now be described with reference to FIG. 4. The unit 200 has a main body 201 which is provided with a moving table 202 movable toward and away from the web supply-connection apparatus 100. A nut member 205 is provided on the moving table 202 and engages a screw shaft 204 rotated by a motor 203 in a normal direction and in the opposite direction thereto.

A rotary head 206 is provided on the moving table 202 so as to rotate in a horizontal plane. A plurality of web roll storing shafts extend horizontally from the rotary shaft 206 so that they are separated by the same angle from one another. In the case of FIG. 4, two web roll storing shafts 207*a* and 207*b* extend from the rotary shaft 206 in the opposite directions so that they are separated by 180° from each other. A great number of web rolls 1 are axially slidably mounted on the web roll storing shafts 207*a* and 207*b*. Each web roll storing shaft has a pushing-out mechanism 208. The mechanism 208 moves axially of the respective web roll storing shaft and moves the web rolls 1 held on the web roll shaft to push them out one by one from the front end of the shaft.

When either one of the web roll storing shaft 207*a* and 207*b* faces the web supply-connection apparatus 100, it is axially aligned with the left-side hub 104*b*. After the webs have been connected together and the free hub (i.e., the hub from which the core was removed) has been moved leftward by the rotary arm 102, the moving table 202 of the web roll storage-connection unit 200 is moved together with the rotary head 206 and the web roll storing shafts 207*a* and 207*b* until the front end of the web roll storing shaft 207*a* abuts against the front end of the free hub. In this condition, the pushing-out mechanism 208 pushes out a web roll 1 held by the web roll storing shaft facing the web supply-connection apparatus 100 and then mounts the same on the free hub.

This process is repeated in such a way that, when the roll on the operating web roll is going to be fully used, a new web is drawn from the web roll which was in a waiting state so that the leading end portion of the new web is connected to the trailing end portion of the previously drawn-out web, whereby the webs are continuously supplied and a new web roll is mounted on the free hub.

Figure 5:
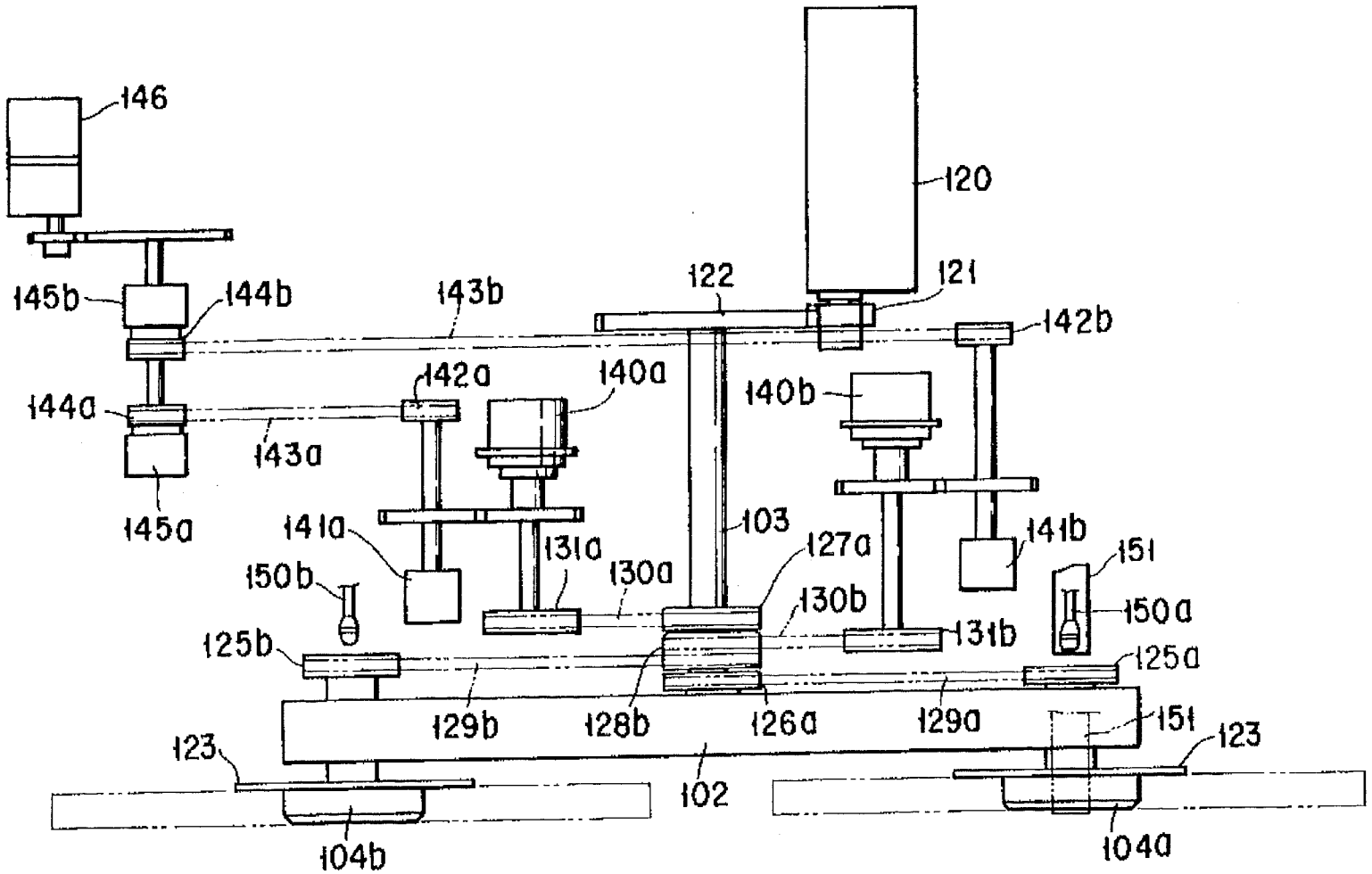
FIG. 5 is a general plan view of the driving system of a rotary arm and hubs.

The driving mechanism of the rotary arm 102 and the hubs 104*a* and 104*b* will now be described with reference to FIG. 5. The rotary shaft 103, to which the central portion of the rotary arm 102 is pivoted, is rotated by a motor 120 through gears 121 and 122. Each of the hubs 104*a* and 104*b* is provided with a flange portion 123.

The hub 104*a* is connected to a power brake 140*a* and a rotary encoder 141*a* through a pulley 125*a*, pulleys 126*a* and 127*a* rotatable together about the rotary shaft 103, a pulley 131*a* and belts 129*a* and 130*a*. The hub 104*b* is connected to a power brake 140*b* and a rotary encoder 141*b* through a pulley 125*b* a pulley 128*b* rotatable with respect to the rotary shaft 103 and the pulleys 126*a* and 127*a*, a pulley 131*b* and belts 129*b* and 130*b*. As the web is taken out from a web roll on the operating hub, the web is provided with predetermined resistance, i.e., a predetermined tension, and the number of rotations, the taken-out length of the web and the like are detected by the respective encoder.

The power brakes 140*a* and 140*b* and the rotary encoders 141*a* and 141*b* are connected to a motor 146 through a connection mechanisms comprising pulleys 142*a* and 142*b*, belts 143*a* and 143*b*, pulleys 144*a* and 144*b* and clutches 145*a* and 145*b*. The hubs 104*a* and 104*b* are rotated in a normal direction and in the opposite direction, respectively, by the motor 146 through the connection mechanism.

Provided with each of the hubs 104*a* and 104*b* is a chucking mechanism (not shown) operated under a pneumatic pressure. An air passage is formed in the shaft portion of each of the hubs 104*a* and 104*b*. Reciprocating air pressure connectors 150*a* and 150*b* are provided behind the shafts of the hubs 104*a* and 104*b*. As the connectors advance and are connected to the air passages of the hubs 104*a* and 104*b*, pneumatic pressure is supplied to the chucking mechanisms of the hubs 104*a* and 104*b* and operates the same.

Behind the right-side hub 104*a* is provided a core rejecting member 151 which is movable back and forth. As the core rejecting member 151 advances, it passes through a hole formed in the flange portion 123 and pushes the free core (i.e., the core from which the web is drawn out) on the right-side hub 104*a* to reject the same.

Figure 6:
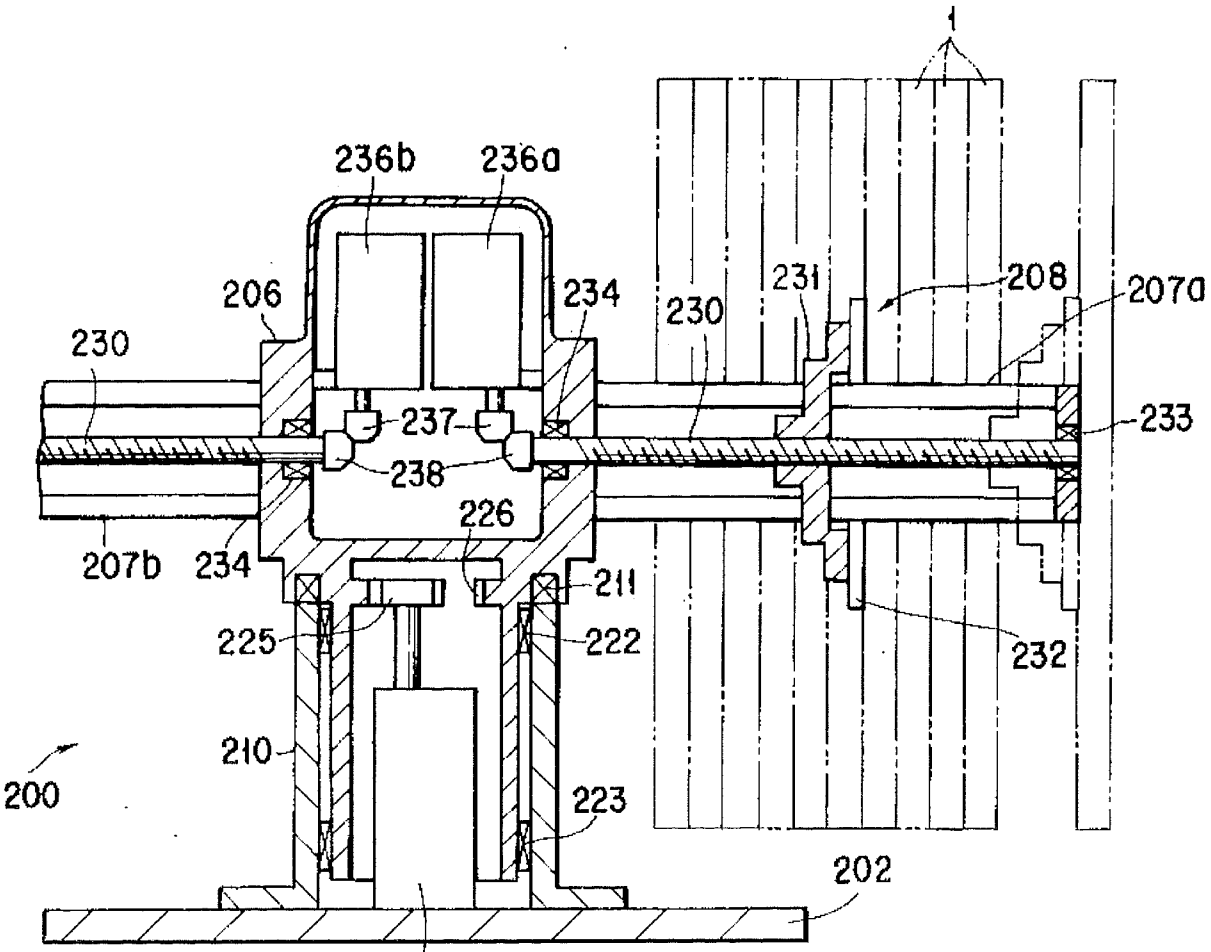
FIG. 6 is a longitudinal cross-sectional view of the main part of the web roll storage-mounting unit.

As shown in FIG. 6, the web roll storage-mounting unit 200 has the moving table 202 and a cylindrical supporting member 210 projecting upward therefrom. The rotary head 206 is rotatably supported on the supporting member 210 by bearings 211, 222 and 223. In the rotary head 206 is formed an internal gear 226 which meshes with an external gear 225 driven by a motor 224. The rotary head 206 is rotated in a horizontal plane by the motor 224.

The pushing-out mechanism 208 comprises the hollow web roll storing shafts 207*a* and 207*b* and screw shafts 230 coaxially extending through the shafts 207*a* and 207*b* and rotatably supported by bearings 233 and 234, respectively. The screw shafts 230 are rotated by motors 236*a* and 236*b* through bevel gears 237 and 238, respectively.

Engaged with the screw shafts 230 are nut members 231 which extend out of the web roll storing shafts 207*a* and 207*b* through axial slots formed therein. A flange member 232 is fixed to each nut member 231.

As the screw shafts 230 are rotated by the motors 236*a* and 236*b*, the nut members 231 and the flange members 232 are moved axially to push out the web rolls 1.

Figure 8:
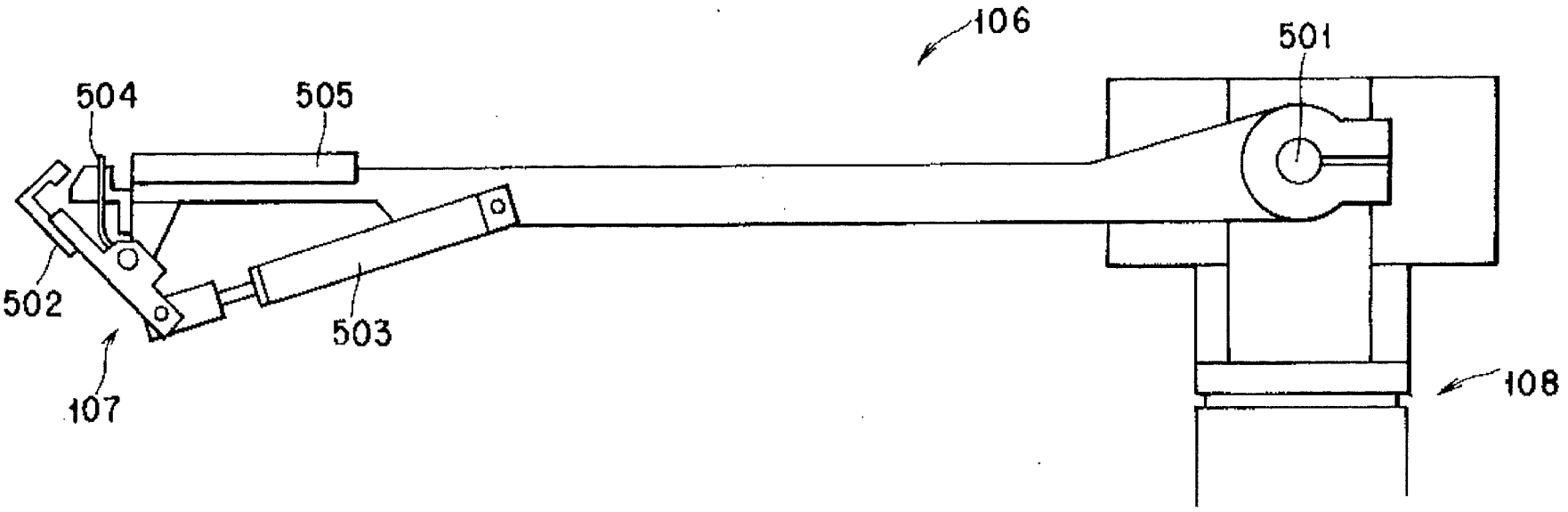
FIG. 8 is a front view of a drawing-out arm.

As shown in FIG. 8, the proximal end portion of the drawing-out arm 106 is rotatably mounted on a shaft 501 so that the drawing-out arm 106 is rotated about the shaft 501 in a vertical plane.

The chucking mechanism 107 is provided on the distal end portion of the drawing-out arm 106. The chucking mechanism 107 comprises a chucking member 502 and a cylinder 503 for opening and closing it. A hollow suction mechanism 505 having a great number of holes formed in its upper surface is provided on the upper surface of the distal end portion of the drawing-out arm 106. The interior of the suction mechanism 505 is connected to a negative-pressure generating mechanism (not shown) for rendering the pressure in the interior of the mechanism 505 negative.

A leading end portion detector 504 is provided on the distal end portion of the drawing-out arm 106. The leading end portion detector 504 is, for example, an optical detector including optical fiber, or the like and is used for detecting the front edge of detaching part 5 of the web of the web roll 1.

When the leading end portion of the web is to be drawn out from the web roll 1*b*, the drawing-out arm 106 is rotated until it takes a horizontal position so that the suction mechanism 505 provided on its distal end portion abuts the lowest surface portion of the web roll 1. Since the pressure in the suction mechanism 505 is negative in this condition, air is introduced from the outer atmosphere into the mechanism 505, whereby the portion of the web which is the outer periphery of the web roll is sucked in by the mechanism 505. Then, the web roll is rotated in the direction opposite to the direction in which the web is wound on the core. When the front edge of the detaching part 5 of the web arrives at the chucking mechanism, the leading end portion detector 504 detects the front edge. The chucking member 502 of the chucking mechanism 107 is driven by the cylinder 503 so as to hold the detaching part 5 of the web.

The drawing-out arm 106 holding the leading end portion of the web is rotated downward until it takes a substantially vertical downward position and the entire drawing-out arm 106 is lowered by the lifting mechanism 108, whereby the web held by the drawing-out arm 106 is pulled out. Since the adhering force of the adhesive tape 4 is weak, the tape 4 is easily detached and the web is not damaged.

The structure of the feed mechanism 109 will now be described with reference to FIG. 9. The feed mechanism 109 comprises an elongated hollow main body 510 and pulleys 511 and 512 provided on the upper and lower ends, respectively. An endless suction belt 513 is wound on the pulleys 511 and 512. The suction belt 513 is formed with a great number of holes so as to provide air-permeability or porosity. The suction belt may be made of air-permeable material such as fiber. At the left side of the main body 510, the suction belt 513 is exposed to the outer atmosphere. Air tightness is maintained between both sides of the suction belt 513 and the main body 510. The interior of the main body 510 is connected to a negative-pressure generating mechanism (not shown) through a plurality of negative-pressure introducing ports 514 so that the pressure in the main body 510 is maintained negative.

Figure 9:
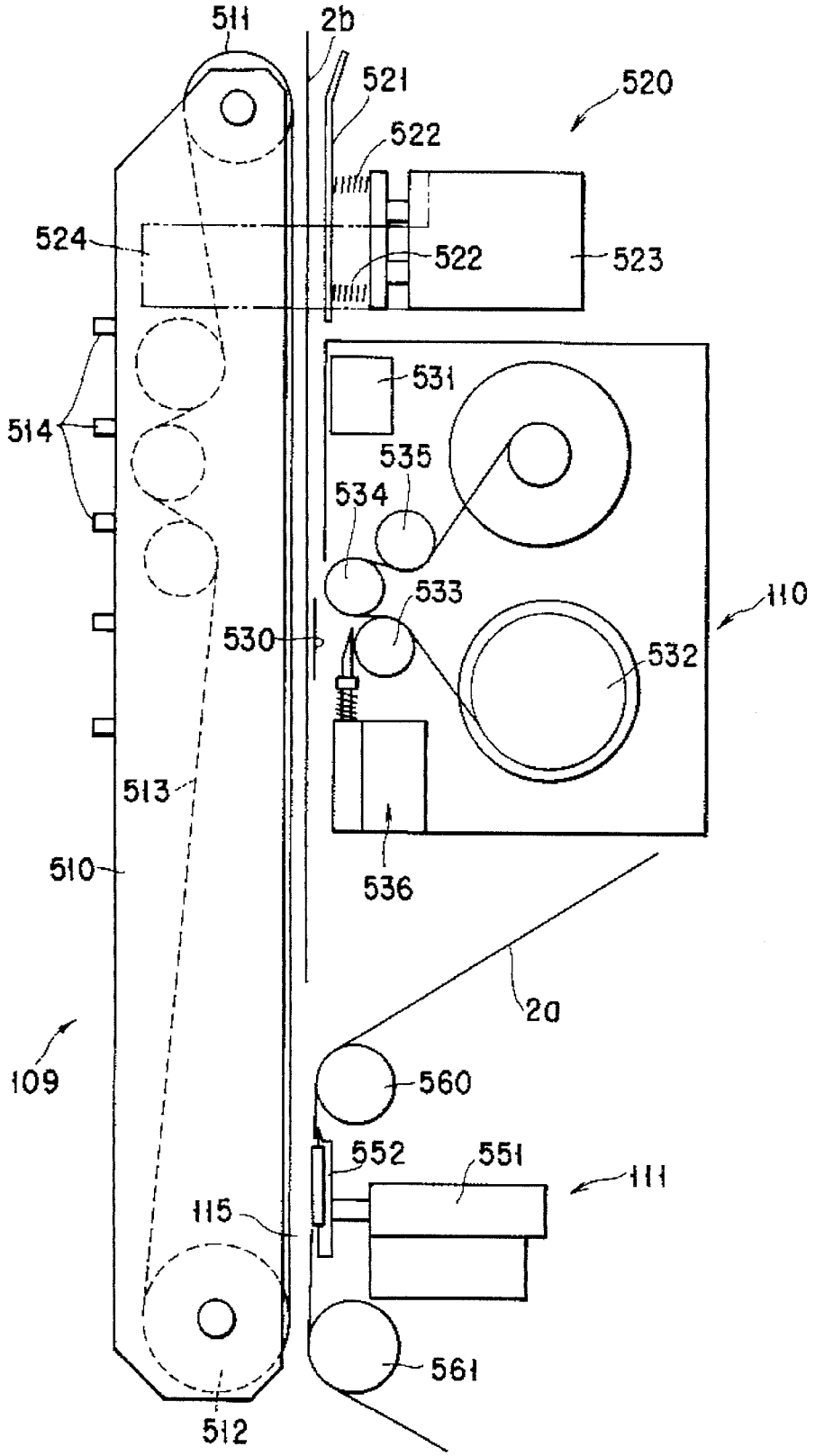
FIG. 9 is a front view showing the portions of a feed mechanism and an adhesive tape supplying mechanism.

A holding late mechanism 520 is fixed to the upper portion of the main body 510 of the feed mechanism 109 and is provided with a holding late 521 having a smooth surface and connected to an actuator 523 through a spring 522. The actuator 523 is fixed to the main body 510 by a fixing late 524 provided on the front side of the actuator 523.

when the drawing-out arm 106 holds the leading end portion of the web 2*b* of the new web roll 1*b* and is moved to the vertical downward position as shown by the two-dot lines in FIG. 3 by pulling out the web 2*b*, the feed mechanism 109 is moved to the substantially vertical position as shown in FIG. 9, and the suction belt 513 on the upper portion of the feed mechanism 109 abuts the leading end portion of the web 2*b*. The negative pressure in the main body 510 of the feed mechanism 109 and the porosity of the suction belt 513 allows the suction belt 513 to suck in the leading end portion of the web. Then the drawing-out arm 106 releases and the leading end portion of the web which sucked in and accurately held by the suction belt 513. For convenience, the web 2*b* is shown in a state separated from the suction belt 513 in FIG. 9, but the web 2*b* closely contacts the suction belt 513 in the real condition.

At the same time, the holding late mechanism 520 operates so that the holding late 521 is moved by the actuator 523 to cause the leading end portion of the web to closely contact the suction belt 513. In doing so, the web 2*b* closely contacts the suction belt 513 and is sucked in more strongly.

In this condition, the suction belt 513 runs and the web 2*b* is sent downward while the web 2*b* is sucked in by the suction belt 513.

The adhesive tape supplying mechanism 110 is provided so as to face the intermediate portion of the feed mechanism 109. The mechanism 110 is used to attach the adhesive tape 530 to the leading end portion of the web 2*b*. On the upper portion of the adhesive tape supplying mechanism 110 is provided a leading end portion detector 531 which is, for example, an optical detector for detecting the leading end portion of the web 2*b* when the web passes the detector 531.

Figure 10:
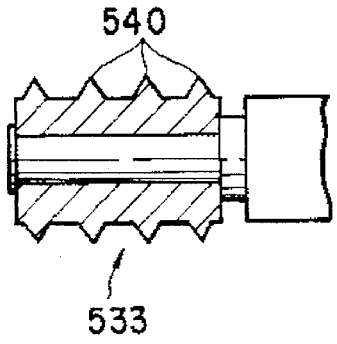
FIG. 10 is a longitudinal cross-sectional view of a roller.
Figure 11:
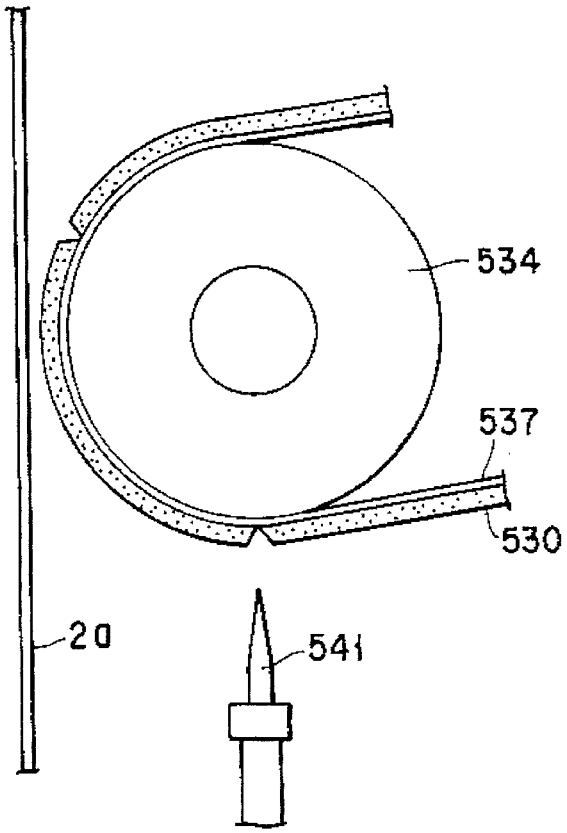
FIG. 11 is a front view of the main part of the adhesive tape supplying mechanism.

As shown in FIGS. 9 to 12, the adhesive tape supplying mechanism 110 includes an adhesive tape reel 532 from which a composite tape comprising a paper base tape 537 and an adhesive tape 530 of double-sided adhering type attached to the reel 537 is supplied as shown in FIG. 11. The composite tape passes on the rollers 533, 534 and 535 and is wound on a tape reel with the adhesive tape 530 disposed outside. As shown in FIG. 10, the roller 533 contacting the adhesive tape 530 is provided with a plurality of ribs 540 each having a sharp outer edge so that the contact area of the ribs 540 with the adhesive tape 530 is made as small as possible to prevent the adhesive tape 530 from being attached to the peripheral surface of the roller 533.

As shown in FIG. 11, only the adhesive tape 530 disposed outside of the composite tape on the roller 534 is cut at predetermined intervals by means of a cutting mechanism 547. A piece of the thus cut adhesive tape 530 adheres to the leading end portion of the lowering web 2*b* and is separated from the base tape 537. As a result, the adhesive tape piece is attached to the leading end portion of the web 2*b*.

Figure 12:
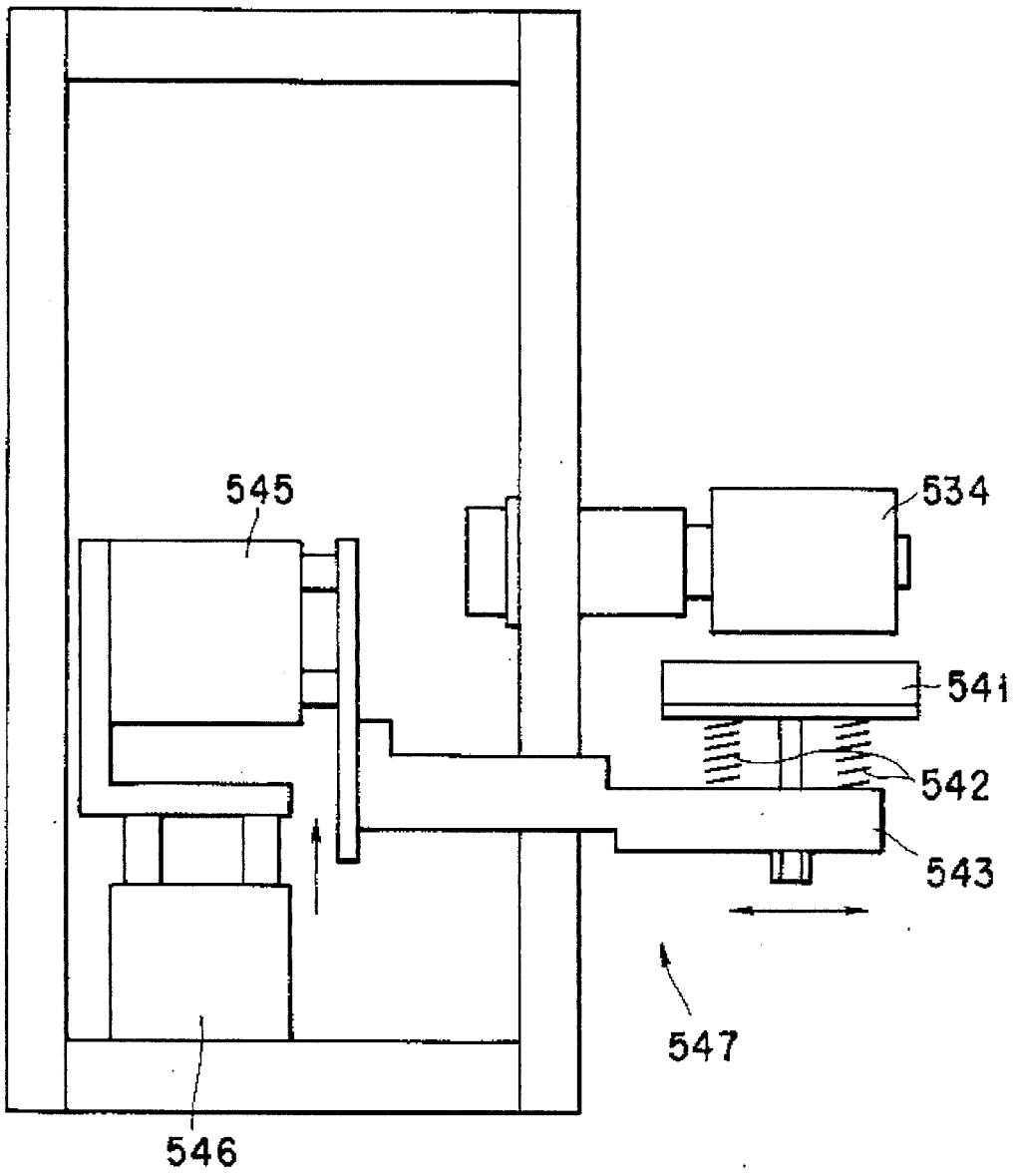
FIG. 12 is a side view of the adhesive tape supplying mechanism.

As shown in FIG. 12, the cutting mechanism 547 has a cutter 541 connected to a moving member 543 through a springs 542. The moving member 543 is fixed to a transverse reciprocating actuator 545 and is moved thereby in the traverse directions of the adhesive tape. The actuator 545 is fixed to a lift actuator 546 which lifts and lowers the actuator 545, the moving member 543 and the cutter 541 at the same time.

The cutter 541 is raised by the lift actuator 546 and is in light contact with the adhesive tape 530 by the urging force of the springs 542. Simultaneously, the cutter 541 is reciprocated in the transverse directions of the tape by the actuator 545. In this process, the hard base tape 537 is not cut but only the soft adhesive tape 530 is cut.

Figure 13:
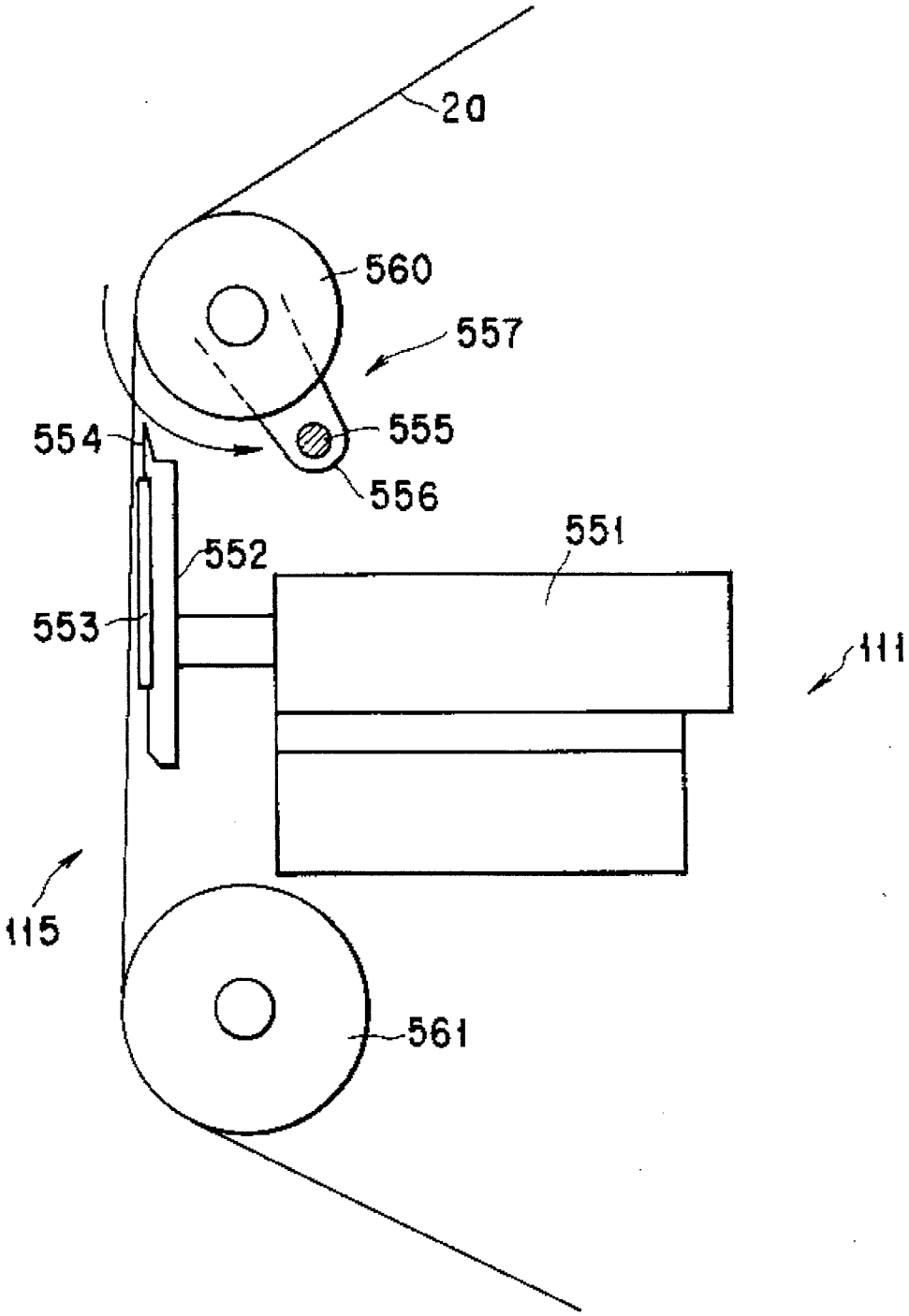
FIG. 13 is a front view of a pressing mechanism.

Referring to FIGS. 9 and 13, a pressing mechanism 111 is disposed under the adhesive tape supplying mechanism 110. More specifically, the web 2*a* being taken out is guided by pulleys 560 and 561 and moved vertically in a region between these pulleys. The pressing mechanism 111 is provided in this region and comprises a pressing member 552, a pad 553 made of synthetic rubber or the like and provided on the front face of the pressing member 552, and a cutter 554 formed on the upper end of the pressing member 552. The pressing member 552 is pressed against the web 2*a* by an actuator 551.

As a web 2*b* is sent downward by the feed mechanism 109, its leading end portion is detected by the leading end portion detector 531, and then the web 2*b* stops running after it has been supplied by a predetermined length. An adhesive tape 530 is attached to the predetermined part of the leading end portion of the web 2*b*. Thereafter, the web 2*b* is sent downward further and stops again at the position of the pressing member 552. The pressing member 552 is moved forward by the actuator 551 and presses the web 2*a* against the adhesive tape 530 on the web 2*b*, whereby the leading end portion of the web 2*b* which is being drawn out is connected to the trailing end portion of the previously drawn-out web 2*a*.

The pressing mechanism 111 includes a cutting mechanism 557 for cutting a web 2*a* which is being drawn out. The cutting mechanism 557 has a cutting rod 555 which passes the region close to the cutter 554 on the upper end of the pressing member 552 by means of a driving mechanism including an arm 556. The web 2*a* is caught, pressed against the cutter 554 and cut by the moving cutting rod 555. It is preferred that the cutter 554 take a form of saw teeth in order to cut the web easily.

Figure 14:
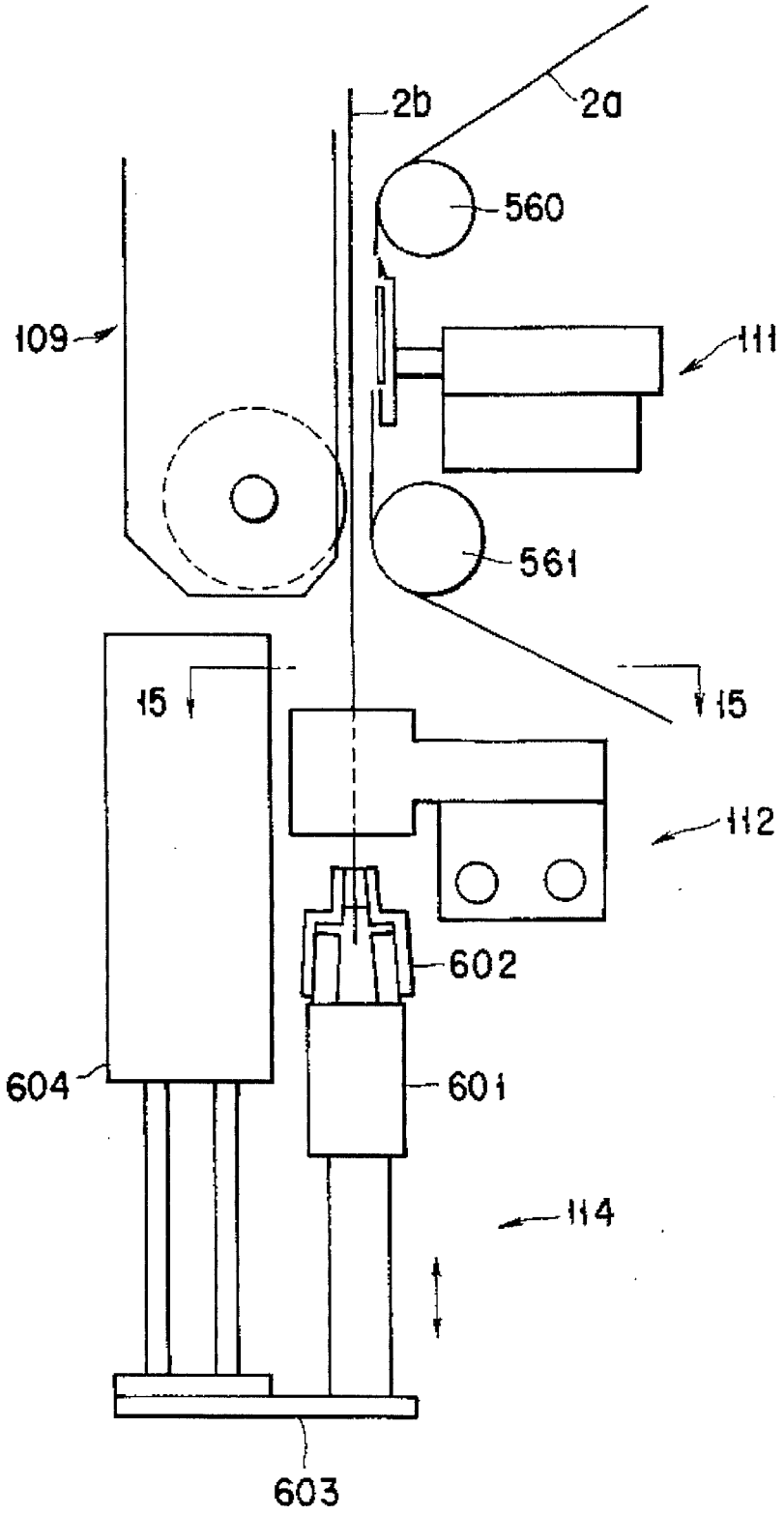
FIG. 14 is a front view of the portions of a cutting mechanism and a chucking mechanism.
Figure 15:
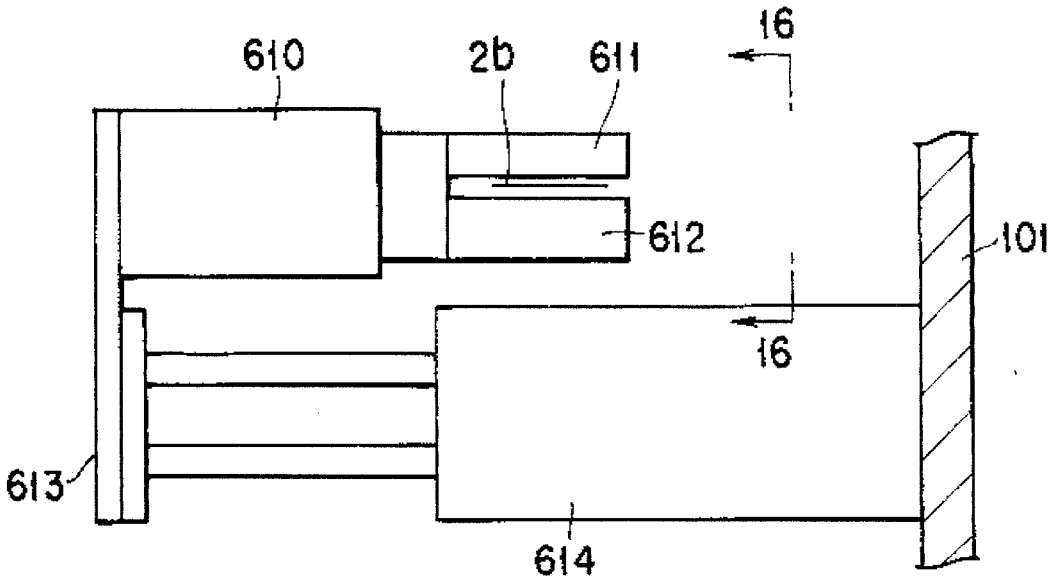
FIG. 15 is a cross-sectional view taken along line 15—15 of FIG. 14.

Referring to FIGS. 14 and 15, a cutting mechanism 112 and a chucking mechanism 114 for cutting the portion of the newly supplied web 2*b* between the adhesive tape 530 and the leading end edge of the web 2*b*, i.e., an excess portion of the leading end portion of the web 2*b* including the adhesive tape 4 and the detaching part 5 are provided under the pressing mechanism 111.

As shown in FIG. 14, the chucking mechanism 114 has a pair of chucks 602 and an actuator 601 which opens and closes the chucks 602. The actuator 601 is connected to a lift cylinder 604 by a moving member 603 and moves the cylinder 604 upward and downward. The chucks 602 hold the leading end portion of the lowered web 2*b* and are lowered to give predetermined tension to the web 2*b*.

Figure 16:
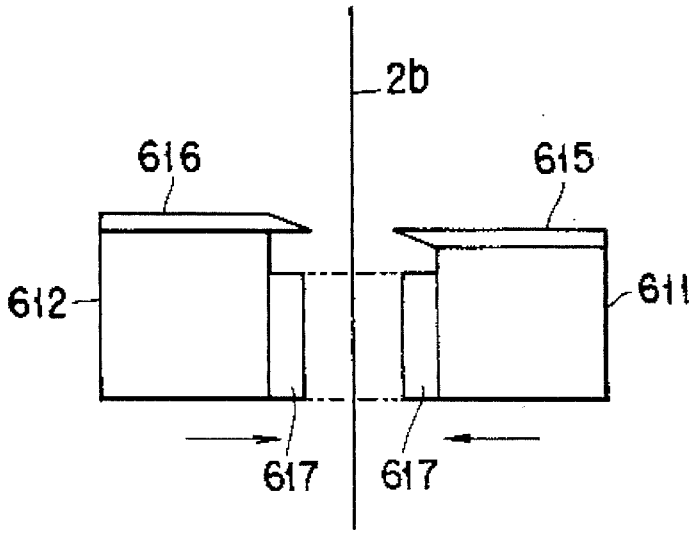
FIG. 16 is a cross-sectional view taken along line 16—16 of FIG. 15.

Referring to FIGS. 14 to 16, the cutting mechanism 112 includes a pair of cutting members 611 and 612 opened and closed by an actuator 610, for cutting the portion of the web 2*b* between the cutting members 611 and 612. The cutting members 611 and 612 and the actuator 610 are connected to an actuator 614 through member 613 so that they are moved together back and forth.

The cutting members 611 and 612 carry cutting teeth 615 and 616 and holding members 617 disposed below the respective cutting teeth 615 and 616. The holding members 617 are made of elastic material such as synthetic rubber and hold the leading end portion of the cut web 2*b* therebetween. The members 617, which are holding the leading end portion of the cut web 2*b*, are moved forward by the actuator 614 to the position above a container for housing the cut portion of the web 2*b*. Thereafter, the members 617 are separated from each other to release the leading end portion of the web which was held by the members 617 and let the web fall into the container. Therefore, the leading end portion of the web is securely contained in the container and the leading end portion of the cut web is not caught by any part of the device, preventing any trouble due to this catching of the leading end portion.

This invention is not limited to the above-mentioned embodiment and various modifications are available as long as they are not departed from the scope of this invention.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A device for connecting a trailing end of a previously drawn-out web from a first web roll to a leading end portion of a newly drawn-out web from a second web roll comprising:

substantially vertical guide means for guiding said previously drawn-out web so as to be supplied substantially vertically;

drawing-out means for drawing out said leading end portion of said web from said second web roll;

feeding means for guiding and feeding substantially vertically downward said leading end portion of said newly drawn-out web in a vicinity of and along said previously drawn-out web guided substantially vertically by said substantially vertical guide means;

adhesive tape supplying means for attaching an adhesive tape to said leading end portion of said newly drawn-out web; and cutting means for cutting predetermined portions of said webs;

said adhesive tape supplying means and cutting means being arranged along a side of said substantially vertical guide means;

said drawing-out means including a drawing-out arm which is rotated in a vertical plane and moved up and down by driving means, said drawing-out arm holding the leading end portion of the newly drawn-out web, then rotating and descending to draw out the leading end portion of the web in a substantially vertical direction such that the leading end portion of the web is in a standby state while being held downward;

said feeding means comprising:

a hollow main body;

an endless suction belt made of an air-permeable material and provided on said hollow main body so as to run substantially vertically downward; and negative pressure introducing ports provided on said main body, for applying a negative pressure to an interior of said main body therethrough so that said negative pressure is maintained in the interior of said main body and air is introduced into the interior of said main body, whereby a suction force produced by said negative pressure in the interior of said main body and said air introduced into the interior of said main body works in conjunction to hold said leading end portion of said newly drawn-out web;

said feeding means being mounted so as to be rotated in a substantially vertical plane by rotating means, and rotating from a substantially horizontally inclined position toward the substantially vertical position by said rotating means such that the feeding means moves toward a side of the leading end portion of the web which is held downward by the drawing-out arm, is brought into tight contact with the leading end portion of the web in substantially parallel relation thereto, and seizes the leading end portion of the web after the leading end portion of the web is released from the drawing-out arm and is suspended in a free state, whereby the leading end portion of the web is transferred to the feeding means.

2. The device according to claim 1, wherein a holding plate having a smooth surface is provided in a vicinity of and in parallel with said suction belt, and said holding plate and said belt hold said leading end portion of said newly drawn-out web therebetween.

3. A device for connecting a trailing end of a previously drawn-out web from a first web roll to a leading end portion of a newly drawn-out web from a second web roll comprising:

vertical guide means for guiding said previously drawn-out web so as to run vertically;

drawing-out means for drawing out said leading end portion of said web from said second web roll;

feeding means for guiding and feeding vertically downward said leading end portion of said newly drawn-out web in a vicinity of and along said previously drawn-out web guided vertically by said vertical guide means;

first cutting means for cutting predetermined portions of said webs; and adhesive tape supplying means which comprises guiding means for guiding a belt-like compound adhesive tape, comprising a base tape and an adhesive tape of a double-sided surface adhering type attached to said base tape, to said leading end portion of said newly drawn web, second cutting means for cutting only said adhesive tape on said base tape into adhesive pieces having a predetermined length, said second cutting means having a blade-like cutter for cutting said adhesive tape, a spring for urging said blade-like cutter toward said adhesive tape and means for reciprocating the cutter in a direction of a cutting edge of the cutter whereby said adhesive pieces in a state attached to said base tape are brought to a position of said leading end portion of said newly drawn-out web and attached thereto.

4. The device according to claim 3, wherein guiding means for guiding said belt-like compound adhesive tape has a roller contacting an adhesive side of said belt-like compound adhesive tape to guide said belt-like compound adhesive tape, and wherein said roller has a plurality of ribs serially arranged on an outer surface of the roller, with tips of said plurality of ribs being sharply formed so as to minimize contact with any area of said adhesive tape guided by said guiding means such that said belt-like compound adhesive tape is prevented from adhering to said roller.

5. A device for connecting a trailing end of a previously drawn-out web from a first web roll to a leading end portion of a newly drawn-out web from a second web roll comprising:

vertical guide means for guiding said previously drawn-out web so as to run vertically;

drawing-out means for drawing out said leading end portion of said web from said second web roll;

feeding means for guiding and feeding vertically downward said leading end portion of said newly drawn-out web in a vicinity of and along said previously drawn-out web guided vertically by said vertical guide means;

adhesive tape supplying means for attaching an adhesive tape to said leading end portion of said newly drawn-out web;

cutting means for cutting predetermined portions of said webs said cutting means having cutting off means for cutting a portion of said newly drawn-out web between said adhesive tape attached to said newly drawn-out web and an end edge of said leading end portion, such that a useless part of said leading end portion of said newly drawn-out web, such as a part adhering to said adhesive tape fixing the web or a kinked detaching part, is removed; and holding members, made of elastic material and each provided on a respective one of said cutting members, for elastically holding said leading end portion, thereby preventing said leading end portion which has been cut from dropping.

6. The device according to claim 5, wherein said cutting means has cut means for cutting a portion of said previously drawn-out web behind a portion thereof at which said trailing end portion of said previously drawn-out web is connected to said leading end portion of said newly drawn-out web, with said cut means comprising a cutter disposed close to a running path of said previously drawn-out web and extending crosswise thereof, and pressing members for pressing said trailing end portion of said previously drawn-out web against said cutter so as to cause said cutter to cut said trailing end portion.

* * * * *